US005842806A

United States Patent [19]

Rettke

[11] Patent Number: 5,842,806

[45] Date of Patent: Dec. 1, 1998

[54] SEALS FOR CAPPED ROLL-ON DISPENSER WITH HINGED FLIP-TOP CLOSURE LID

[75] Inventor: Ralph P. Rettke, Naperville, Ill.

[73] Assignee: W. Braun Company, Chicago, Ill.

[21] Appl. No.: 962,262

[22] Filed: Oct. 31, 1997

[51] Int. Cl.[6] ..... B43K 23/08

[52] U.S. Cl. ..... 401/213; 215/237; 401/214

[58] Field of Search ..... 401/213, 214; 215/237

[56] References Cited

U.S. PATENT DOCUMENTS

| | | | |
|---|---|---|---|
| 3,103,691 | 9/1963 | Stull | 401/213 |
| 4,221,494 | 9/1980 | Kachur | 401/214 |

*Primary Examiner*—David J. Walczak
*Assistant Examiner*—Tuan N. Nguyen
*Attorney, Agent, or Firm*—Michael G. Berkman

[57] ABSTRACT

A roller-type storage container, dispenser and applicator includes a ball centered in a ball-retaining socket in a cap threadedly surmounting a container body. The cap is joined through an integral live hinge to a lid which is formed with an interior annular ring. Upon closure of the pivotally-hinged lid, the interior annular ring engages and bears inwardly against an outer upper wall section of the ball-retaining socket of the cap and urges the wall of the ball-retaining socket into positive, fluid-sealing engagement against the ball surface. Simultaneously, a vertically-directed force vector, generated during closure forces impressed by the lid upon the cap, bears upon the ball-retaining socket and forces the ball downwardly to seal against an annular, radially-inwardly-presented sealing ring integrally formed at a base of the ball-retaining socket, to seal the contents of the container therewithin.

2 Claims, 3 Drawing Sheets

SEALS FOR CAPPED ROLL-ON DISPENSER WITH HINGED FLIP-TOP CLOSURE LID

FIELD AND BACKGROUND OF THE INVENTION

The present invention relates to a product-dispensing container fitted with an applicator ball, and a closure assembly. More particularly, the invention is directed to a container fitted with a ball-containing closure assembly including a cap integrally formed with a pivotal lid to which it is secured by an integrally formed live hinge.

Containers with ball-type dispensor applicators are well known in the art. Such articles have taken various forms and mechanical configurations. The physical design and the arrangement of component elements devised have taken varied physical formats, each arrangement being aimed at satisfying the known need to provide effective and reliable seals, and to ensure positive and regulated product storage, delivery and transfer through the expedient of an applicator ball.

Among prior art products are applicator-ball-housing containers and dispensers which utilize a removable threaded cap as a closure. As the cap is threadedly advanced onto the neck of such containers, a component of the cap bears directly down on the surface of the captive, encased ball forcing the latter downwardly to seal the port or principal opening of the container through which stored product is delivered to the ball for exterior application.

The use of snap-secured, or snap-on, or flip-top bottle closures is relatively well known in the bottle or container art. Also known is the use of plastic or live hinges integrally molded with the container body and its cap or closure, as a unitary physical structure. While the desirability of such a hinged closure arrangement in containers fitted with roll-on applicators is clearly evident and has long been appreciated, no satisfactory and no commercially acceptable such structure has heretofore been devised. Each proposed device has failed to satisfy the demands upon such products, either in structural features or in performance. Problems experienced in ensuring proper seals, as well as in limiting the amount of air reaching the ball so as to prevent product dry-out, have thwarted successful development and solutions.

It is, therefore, a principal aim of the present invention to overcome existing obstacles, to provide viable solutions to problems posed, and to eliminate mechanical deficiencies of the types described. The present invention provides, for use with a container employing an applicator ball, a closure assembly of unitary physical construction, including an integrally-formed live hinge component, and which, at the same time, operates effectively and positively to seal the opening into the product storage chamber of the container itself while simultaneously operating to seal the principal surface of the applicator, thus isolating it from outside, ambient air and preventing residual product coating and adhered to the ball from drying out. Thus, the present invention obviates many of the objectionable features, inadequacies and shortcomings of prior art devices of the general class here involved.

SUMMARY OF THE INVENTION

The present invention provides, in a roll-on applicator device, a threaded cap with an integrally-formed flip-top lid, the cap and the lid being joined by an integrally-molded "live hinge" of plastics composition.

It is a principal feature of the invention that the cap component of the closure assembly of the invention is integrally formed with a depending skirt which is, in turn, threadedly surmounted on a cooperating threaded neck of the container.

An important feature of the invention that the cap of the closure assemble defines, interiorly thereof, a ball socket or ball housing in which an applicator ball is functionally confined.

A related feature of the invention is that the cap includes vertically-spaced upper and lower ball-embracing, annular zones, and that in each of these zones wall structures encircling the cap effect contact with the ball confined in the ball socket, housing, or channel formed in the cap.

Yet another feature of the invention is that the ball socket is bounded at an upper extremity thereof by an annular, web-like structure serving as uninterrupted arms or fingers embracing an opposed upper annular sector of the applicator ball, in positive and resilient engagement therewith.

A related feature of the invention is that the web-like structure surmounts the applicator ball and is urged into sealing contact therewith when the lid of the closure assembly is in a closed attitude.

An important feature of the invention is that the ball housing or socket is bounded, at a lower extremity or base thereof, with an integrally-formed annular bead defining, in conjunction the lower surface of the ball, a limited or relatively constricted annular orifice or port. It is through this orifice or passage that product contained in the storage chamber of the device is discharged and transferred to the applicator ball surface for delivery externally of the device.

A related feature of the invention is that the same annular bead serves as a seat on which the applicator ball is supported and with which the ball establishes a positive seal when the lid of the device is closed.

A critical feature of the present invention is the establishment of dual forces or force vectors to act simultaneously on the housed and confined applicator ball when the lid is moved to a closing mode, thereby bringing pressure forces to bear on the upper, ball-embracing arm-like annular zone of the ball housing.

In accordance with the present invention, upon closing the lid, an interior, annular compression ring, integrally formed with the lid interiorly thereof at its base, causes forces to be generated, simultaneously, in two distinct, different directions, that is, laterally as well as downwardly against the upper, ball-embracing, arm-like or finger-like structure of the ball housing. The generated forces urge the ball-embracing structure inwardly, sealingly to bear against the ball surface. At the same time, the lid-carried compression ring acts to urge the ball downwardly in the housing to establish a positive seal with the sealing bead at the base of the ball socket or housing.

In a preferred embodiment of the invention, the lid and the cap of the container are formed with cooperating, interlocking elements which interengage functionally when the lid is urged to a closed disposition.

It is a feature of the present invention that it is susceptible of assuming any of several different and distinct embodiments or design configurations, Two such examples of devices incorporating the elements of the present invention are illustrated and described herein. In a first embodiment, the container body, which is generally cylindrical or tubular, is summounted by a cap which is flared upwardly and outwardly at its uppermost extremity. The cap is integrally formed with a smoothly vaulted lid, the latter being pivotally joined to the cap by an integrally-formed live hinge.

It is a feature of a first embodiment of the invention that the lid-carried compression ring is in the form of an annular, circular wall integral with the lid of the device and depending from an under surface of the vaulted lid. With the lid in a closed position, the inner or inside lower edge of the ring overlies and bears inwardly and downwardly against upper wall portions of the ball housing stressingly to engage the applicator ball, to seal therewith and, simultaneously, to urge the ball downwardly to seat on the annular sealing bead at the base of the housing, thereby effectively to seal the discharge port of the container.

In a second embodiment of the invention, the top of the lid, though vaulted, does not extend radially outwardly of the cylindrical body of the container. In this embodiment of the invention, the compression ring carried by the lid on an undersurface thereof constitutes an annular, radially-inwardly-displaced offset formed slightly above a lower limit of the lid.

Other and further advantages, features and objects of the invention will be evident upon a reading of the following specifications and upon consideration of the drawings and the appended claims.

DETAILED DESCRIPTION OF ILLUSTRATED EMBODIMENTS

Figure 1:
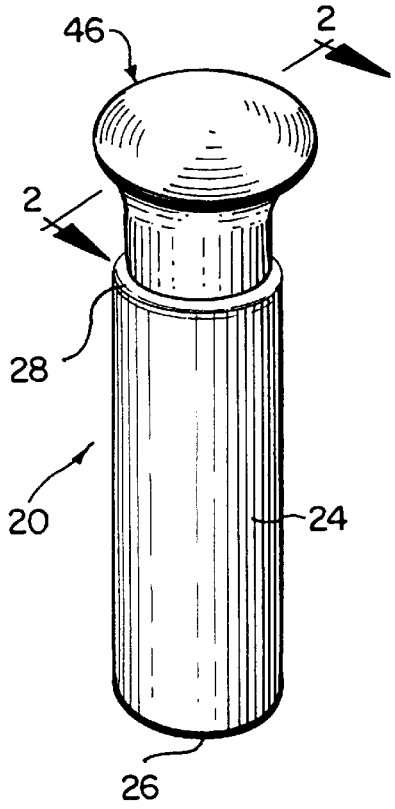
FIG. 1 is a perspective view of one embodiment of the dispenser-applicator according to the invention.

In accordance with the present invention, the aims and objects are achieved, by providing, in conjunction with an open-top container utilizing a product dispensing and applicator ball, a unitary closure assembly comprising a combination cap and lid joined to one another by an integrally-formed live hinge. The cap, which is threaded, is threadedly secured onto a threaded neck which surmounts the body of the container. The cap component of the closure assembly includes an internal chamber or channel whose bounding walls define a housing for the applicator ball nested therewithin.

A critical feature of the invention is that the cap wall, encircling and defining the housing for the applicator ball, is formed, at upper and lower spaced annular zones thereof, with ball-encircling bead or band structures for bearing physically against opposed zonal surface portions of the applicator ball, for sealing thereagainst. A cooperating element is a ring or ring-like annular web integrally formed with the cap, interiorly thereof, and which is brought stressingly to bear against the ball-encasing housing at the upper annular zone of the ball housing when the lid is hingedly pivoted to a closed position over the cap, and is latchedly locked.

A critical functional feature of the invention is that the lid-carried ring which is brought to bear against the annular finger-like band or flange, which encircles and overlies the upper annular zone of the ball, generates, simultaneously, forces or force vectors in each of two different and distinct directions. A first force presses radially inwardly to urge the upper portion of the housing wall inwardly to seal positively with the ball surface in an upper annular zone thereof. A second force, also generated when the lid is snapped closed, presses the upper wall portion of the housing against the captive ball in an annular zone which is above a diameter of the ball, thus producing a vertically-directed force which acts downwardly on the ball to bring the ball into fluid-sealing engagement against the annular sealing bead at the base of the ball housing.

In the structure and arrangement described, when the flip-top, snap-action lid of the closure assembly of the invention is closed, significant pressure is exerted radially inwardly by squeezing the ball housing from the "outside". The effect of the closing of the flip-top, snap-lock lid is to produce two seals of the housing with the ball, one at the opening in the neck of the container, and the second near to top of the ball. The important result is to prevent any residual product on the ball from leaking out of the closure, and also to limit the amount of air which can reach lower ball surfaces, thus preventing product dryout.

Referring more particularly to the drawings, for purposes of disclosure, and not in any limiting sense, two, somewhat varied, embodiments of the invention are illustrated. The first embodiment, shown in FIGS. 1 through 6, depicts a product storing and dispensing container 20 consisting of an elongate tubular body or upstanding wall 24, cylindrical in form, and an integrally molded floor or base 26. At its upper end the tubular body 24 of the container 20 forms a shoulder 28 upwardly of which extends an integrally-formed threaded 30 neck 34, which defines an opening or port 36 at its top 38.

Figure 3:
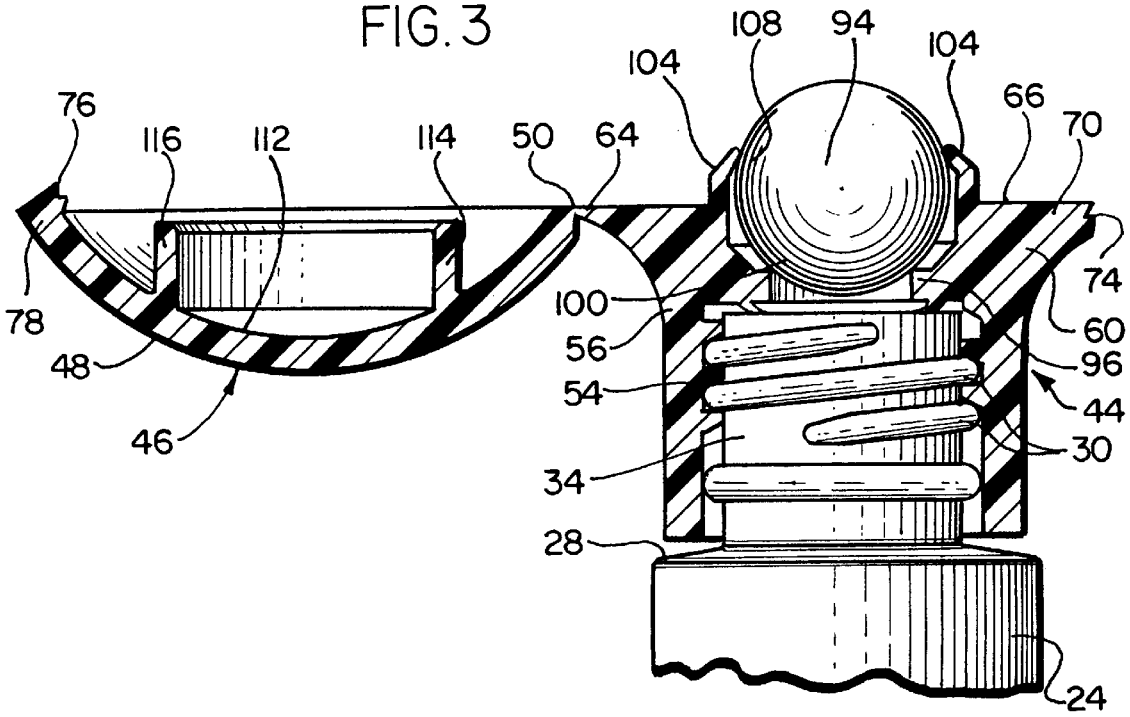
FIG. 3 is a view showing the hinged lid of FIG. 2 in an open mode.
Figure 4:
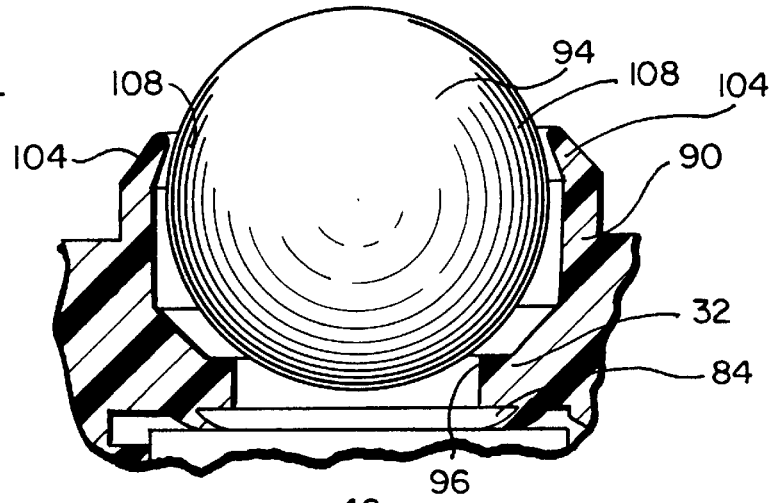
FIG. 4 is an enlarged, fragmentary view of the ball-retaining socket of FIG. 3, the lid of the container being hinged open.

A second principal component of the product storage and applicator device 20 of the invention is a closure assembly 40 consisting of a cap 44 joined to a pivotal flip lid 46 at an edge of its vaulted top 48 through an infegrally-molded live hinge 50. (FIG. 3). At its lower end the cap 44 defines an annular skirt 52 formed interiorly with threads 54 for matingly engaging the cooperating threads 30 formed on the exterior of the container neck 34. At its upper extremity 56 the cap 44 is integrally formed with an upwardly and outwardly projecting body 60. At an edge portion 64 of an essentially flat top surface 66 of the body 60 of the cap 44 of the closure assembly 40, the integrally formed live hinge 50 joins the cap 44 with the pivotally mounted lid 46. At its end edge 70 of the body 60, diametrically opposed to the hinge 50, the body 60 of the cap 44 is formed with a latch element 74 which engages and locks with a cooperating latching element 76 formed on that end edge 78 of the lid 46 diametrically opposite the hinge 50.

As shown in FIGS. 2 through 5, the body 60 of the cap 44 is formed at its base with a radially inwardly extending annular ledge 82 which bears and seats upon a top edge surface 84 of the open neck 34 of the of the container 20. Extending upwardly of the annular ledge 82 of the body 60 of the cap 44 is a generally-arcuate, upwardly-directed, annular wall structure 90 in which a principal body portion of an applicator ball 94 is housed and generally confined and embraced. In accordance with the present invention, the ball housing or ball-encircling wall structure 90 engages the ball 94 in two separate and distinct, vertically spaced annular zones. The first or lower zone is identified by an annular ring-like bead 96 being an integral component of the wall structure 90 and extending inwardly thereof. The bead 96 engages the ball 94 at a lower annular line-contact zone 100 thereof, to serve as a seat therefor, and to support the ball 94 in an operational or functional mode. The bead 96 provides, with the ball 94, a sea to the port 36 of the container, as further described herebelow. The second and upper annular zone of engagement of the wall structure 90 with the ball 94 takes the form, at the uppermost extremity of the wall structure 90, of a web-like flange 104 which functions as annularly continuous or uninterrupted fingers or arms 104 for embracing and bearing against an opposed upper annular sector 108 to apply to the ball 94 forces generated when the lid 46 is closed upon the cap 40.

Figure 2:
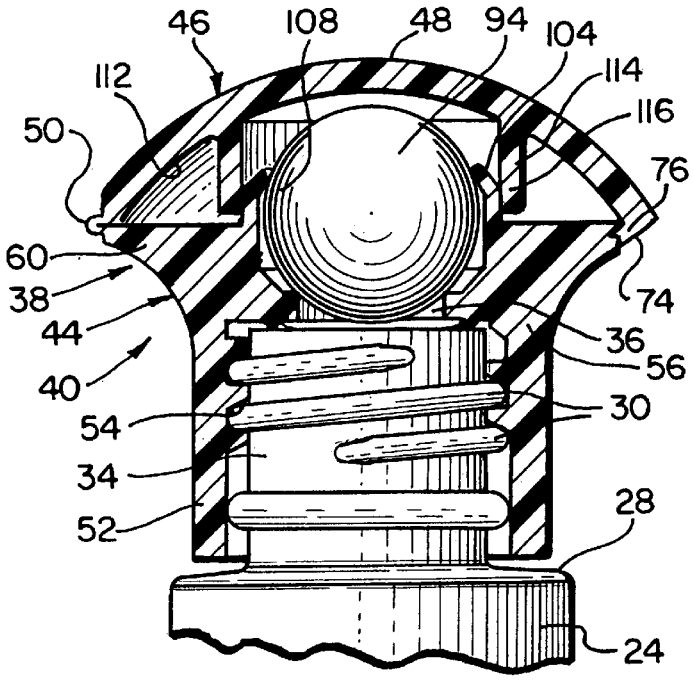
FIG. 2 is a cross-sectional view taken substantially on the lines 2—2 of FIG. 1, and showing the cap-carried hinged lid of the container in a closed and sealing configuration.
Figure 5:
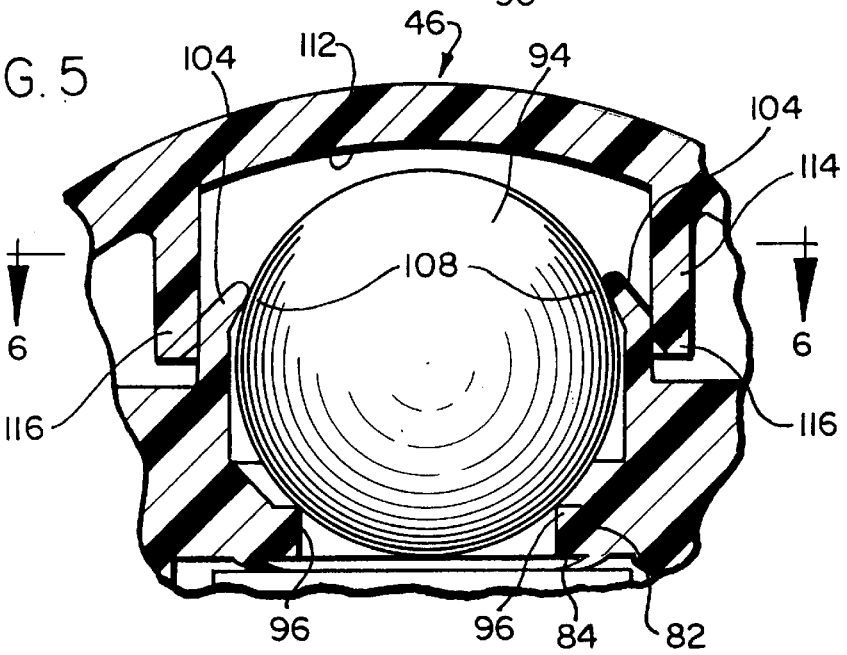
FIG. 5 is an enlarged, fragmentary view of the ball-retaining socket of FIG. 3, the lid of the container being closed.
Figure 6:
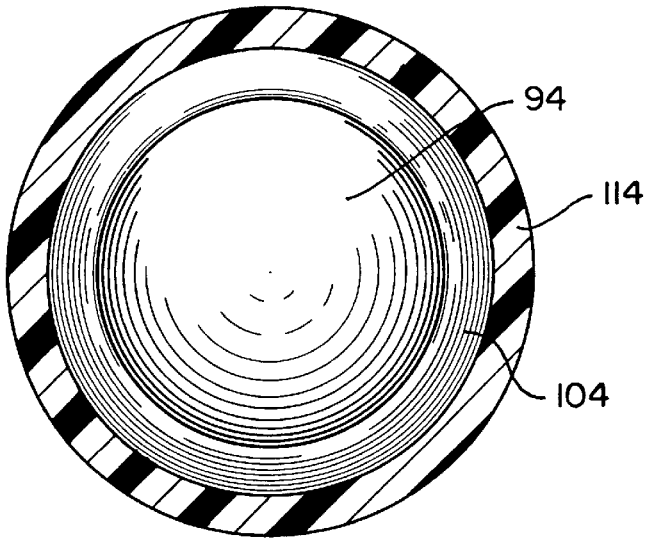
FIG. 6 is a cross-sectional view taken substantially on the lines 6—6 of FIG. 5.
Figure 7:
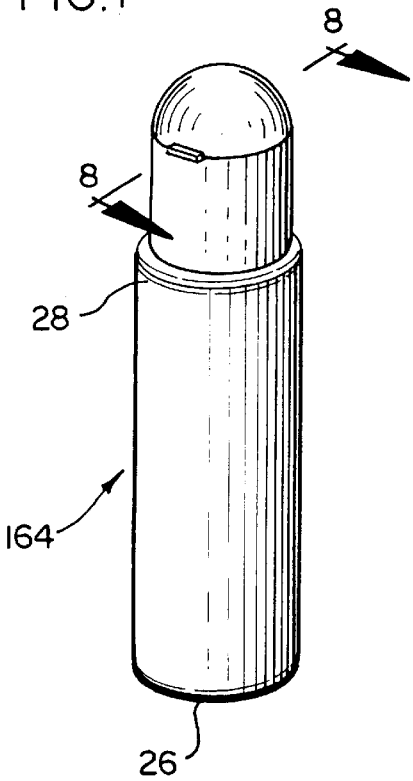
FIG. 7 is a perspective view of a second embodiment of the invention.

Referring now to the structure of the lid in that embodiment of the invention illustrated in FIGS. 1 through 6, and particularly to FIGS. 2, 3 and 5, it will be seen that the vaulted lid 46 is formed on its undersurface 112, to project downwardly therefrom in a centered zone thereof, with an annular ring or ring-like web 114. When the lid 46 is hingedly pivoted to overlie the ball 94 and lockingly to engage the cap 44, the free, projecting, end 116 of the ring 114 is pressed laterally inwardly against the ball-encircling flange 104 at the top of the housing wall or wall structure 90 to seal the flange 104 against the ball 94. At the same time, the upwardly and inwardly angled flange 104 of the housing wall 90 bears inwardly and downwardly on the adjacent upper surface 108 of the ball 94 forcibly to urge the ball 94 downwardly against the bead 96 at the base of the housing wall 90 to seal the opening 36 at the mouth of the container 20. (FIGS. 2 and 5).

A second embodiment of the invention, depicted in FIGS. 7 through 10, differs from the first primarily in the configuration of the upper section or body 150 of the cap 154, and in the configuration of the surmounting lid 160. The container body 164 is the same, and, as in the first embodiment, the lid 160 is connected to the cap 154 by an integrally-formed live hinge 166. Cooperating closure or fastener elements 170 and 172 carried respectively by the lid 160 and the cap 154 secure the two together when the lid 160 assumes a closed configuration.

Figure 8:
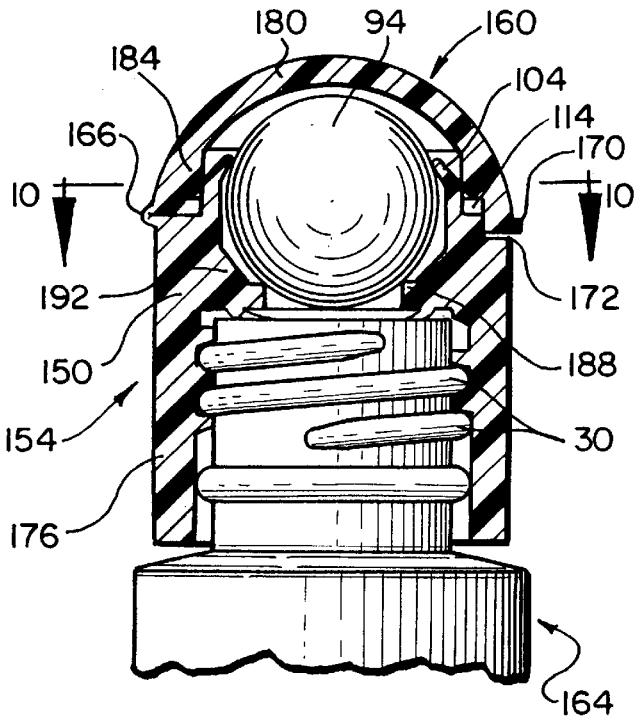
FIG. 8 is a cross-sectional view taken substantially on the lines 8—8 of FIG. 7, and showing the cap-carried hinged lid in a closed and sealing configuration.
Figure 9:
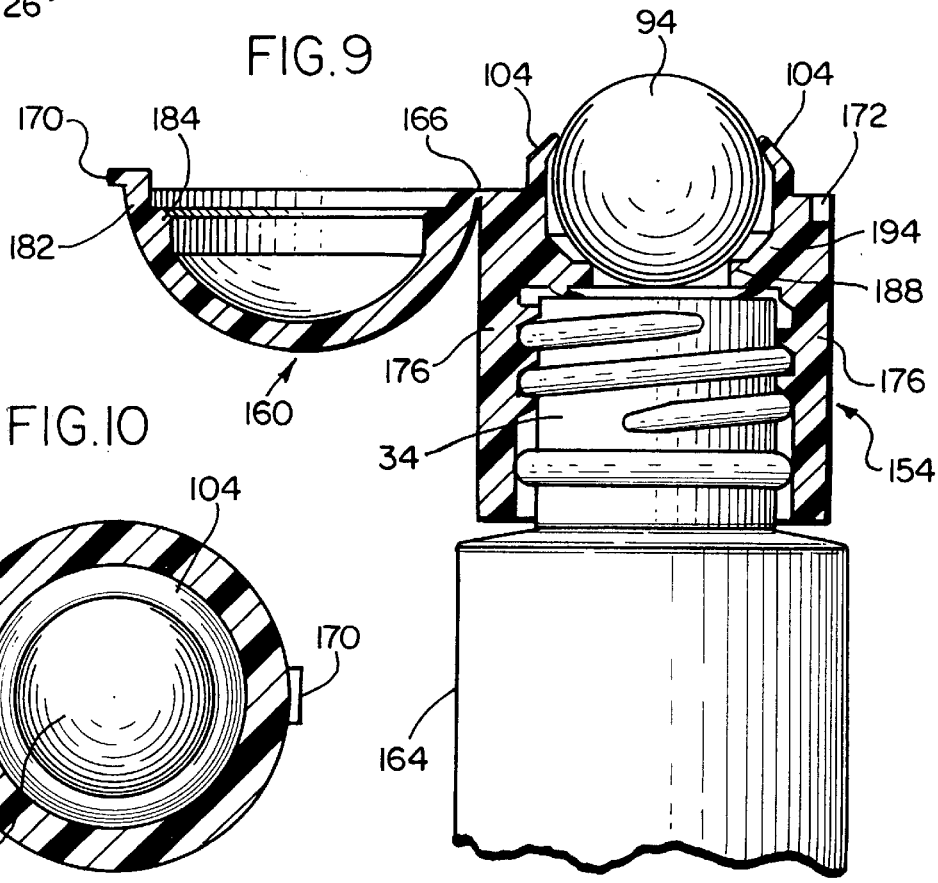
FIG. 9 is a view of the structure shown in FIG. 8, but with the integrally-formed hinge in an open position.
Figure 10:
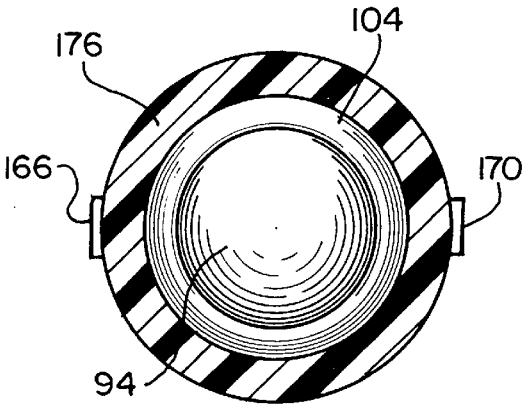
FIG. 10 is a cross-sectional view taken substantially on the lines 10—10 of FIG. 8.

The outside wall 176 bounding the cap 154 is generally cylindrical throughout its expanse. In a closed configuration, the lid 160, with its vaulted wall 180, is a continuation of the cap wall 176 when the lid 160 is closed. (FIG. 8). Interiorly of the lid 160, at the base 182 of the wall 180, is an itegrally-formed, radially-inwardly-directed or disposed ring 184 which, in a closed configuration of the lid 160, is brought to bear against the annular flange 104 at the upper extremity of the cap wall or the ball housing 176. The ring 184 functions in the same manner as does the ring 114 in the first embodiment of the invention. Pressure exerted by the ring 184 against the flange 104 when the lid 160 is closed embodies two force vectors or forces. The first urges the flange 104 toward, to seal against the ball 94. The second bears against the flange 104 to urge the ball 94 downwardly into sealing engagement against the bead 188 at the base 192 of the body 150 of the cap 154, as in the manner described with reference to the first embodiment of the invention.

What is claimed is:

1. In combination with an open-top container integrally formed with a surmounting, upwardly-opening threaded neck, a closure assembly overlying and threadedly secured to said neck of said container, said closure assembly including a cap having circumambient wall means for defining in an upper zone thereof upwardly-opening socket means for retaining a ball therewithin, said socket means defining annular channel means for receiving said ball therewithin, a ball housed in said socket means, said circumambient wall means including a depending, threaded skirt section overlying and threadedly secured to encircle said threaded neck of said container, said wall means of said cap being formed at a base thereof with ball-encircling, radially-inwardly-directed, annular bead-like ring means for abuttingly engaging, supporting and sealing with said ball housed in said socket means, annular arm means bounding an uppermost portion of said channel means for encircling and abuttingly and contiguously engaging said ball in a confronting annular zone of said ball disposed above a horizontal diameter of said ball, lid means for overlying to close said cap of said closure assembly, hinge means integrally formed with said lid means and with said cap of said closure assembly for pivotal, digitally-induced manipulation to provide, selectively, a closed and an open positional attitude of said lid means with said cap of said closure assembly, said lid means being integrally formed with ring-like compressing means carried by said lid means to extend downwardly of an upper interior surface of said lid means for engaging and for bearing upon said annular arm means, thereby to urge said annular arm means laterally against said ball to seal with said ball, while simultaneously urging said ball downwardly within said closure assembly to seat against said bead means of said closure assembly and to seal therewith, and to prevent discharge of product stored in said container, and cooperating intercoupling snap fastener means carried on said lid means and on said cap for locking said lid means on said cap.

2. The structure as set forth in claim 1 wherein said lid means and said cap are integrally formed, and wherein said hinge means is a live hinge of molded plastics composition.

* * * * *